US005178496A

United States Patent [19]

Trieb et al.

[11] Patent Number: 5,178,496

[45] Date of Patent: Jan. 12, 1993

[54] METHOD AND APPARATUS FOR CONVEYING SOLID PARTICLES TO ABRASIVE CUTTING APPARATUSES

[75] Inventors: Franz Trieb, Kapfenberg; Kurt Marchl, Bruck an der Mur, both of Austria

[73] Assignee: Bohler Gesellschaft M.B.H., Kapfenberg, Austria

[21] Appl. No.: 660,879

[22] Filed: Feb. 26, 1991

[30] Foreign Application Priority Data

Feb. 27, 1990 [AT] Austria ..... 449/90

[51] Int. Cl.[5] ..... B65G 53/44

[52] U.S. Cl. ..... 406/14; 406/28; 406/60; 406/106; 406/109; 406/163; 406/173; 51/424; 51/425; 83/53; 83/177

[58] Field of Search ..... 406/14, 30, 56, 60, 406/106, 109, 110, 122, 147, 151, 153, 157, 163, 168, 173, 176, 197; 51/410, 424, 425, 436; 83/53, 177

[56] References Cited

U.S. PATENT DOCUMENTS

| | | | |
|---|---|---|---|
| 1,798,857 | 3/1931 | Tyler | 406/122 X |
| 2,770,924 | 11/1956 | Mead et al. | 51/425 |
| 3,073,070 | 1/1963 | Mead | 51/425 X |
| 3,828,478 | 8/1974 | Bemis | 51/427 |
| 4,183,702 | 1/1980 | Bonnel | 406/56 |
| 4,232,487 | 11/1980 | Brown | 51/425 |
| 4,333,277 | 6/1982 | Tasedan | 51/425 |
| 4,555,872 | 12/1985 | Yie | 51/439 |
| 4,741,130 | 5/1988 | Tano et al. | 51/424 X |
| 4,829,724 | 5/1989 | Miller, Jr. et al. | 51/436 |
| 4,872,293 | 10/1989 | Yasukawa et al. | 51/424 X |
| 4,984,397 | 1/1991 | Van Leeuwen | 51/425 |
| 5,018,317 | 5/1991 | Kiyoshige et al. | 51/436 X |

FOREIGN PATENT DOCUMENTS

| | | |
|---|---|---|
| 0152223 | 8/1985 | European Pat. Off. . |
| 0223433 | 5/1987 | European Pat. Off. . |
| 0110529 | 10/1989 | European Pat. Off. . |

*Primary Examiner*—Margaret A. Focarino
*Assistant Examiner*—Andrew C. Pike
*Attorney, Agent, or Firm*—Sandler, Greenblum & Bernstein

[57] ABSTRACT

A method and apparatus conveys solid particles from a supply device to a charging device for charging free-flowing cutting jets. Positive charging of the cutting jets even when located at a greater or remote distance from the supply device is ensured. To that end, the solid particles are transported in a closed circuit between the supply device and a charging or intermediate storage device and the momentarily required partial quantity of solid particles needed for charging the cutting jet is removed from the closed circuit.

22 Claims, 3 Drawing Sheets

METHOD AND APPARATUS FOR CONVEYING SOLID PARTICLES TO ABRASIVE CUTTING APPARATUSES

CROSS REFERENCE TO RELATED APPLICATION

This application is related to the commonly assigned, copending U.S. application Ser. No. 07/660,936, filed Feb. 26, 1991 and entitled "Method and Apparatus For Loading Free-Flowing Cutting Jets With Solid Particles".

BACKGROUND OF THE INVENTION

1. Field of the Invention

The present invention relates to a new and improved method of, and apparatus for, conveying solid particles, typically abrasive or grinding particles and the like, to an apparatus, particularly a remotely situated apparatus for loading or charging free-flowing or fluent cutting jets with such solid particles, for instance, fluid jet-abrasive cutting apparatuses. Solid particles, preferably in a predetermined quantity, are removed from a container or hopper, introduced into a transport or carrier medium and in conjunction therewith are delivered to the cutting apparatus and held in readiness for charging the cutting jet with these solid particles.

2. Discussion of the Background and Material Information

Liquid jet-cutting apparatuses, using as the cutting implement a thin, free-flowing or fluent cutting jet possessing high kinetic energy, have been beneficially employed for cutting sheet- or surface-like materials. Abrasive cutting is usually required for this type of processing or machining of workpieces or materials possessing high strength, in which case the high velocity fluid cutting jet is charged or laden with solid particles, that is to say, cutting or abrasive particles or the like. When working with abrasive cutting equipment the cutting jet effluxing from a nozzle finally flows through a focusing or constricting nozzle. A negative or lower pressure is produced in a mixing chamber of the cutting jet equipment, by means of which solid particles are sucked out of a container or hopper which is preferably equipped with a dosing device.

Containers or hoppers or the like, which hold in readiness the solid particles, are connected by transport or conveying means, such as for instance, a hose or a line with the cutting apparatus or cutting head, and the conveyance of the solid particles is undertaken by the negative or reduced pressure formed in the cutting head. What is disadvantageous in this regard is that for an adequate transport of the solid particles the transport line or conduit must be of short length, and thus, the distance between the container or hopper and the cutting head is essentially limited to a maximum of 5 meters. Furthermore, especially when interrupting the flow of the solid particles, they tend to settle in the carrier medium because of their greater specific weight, and hence, can obstruct or clog the transport or connection line or the like. Also, small containers or intermediate receptacles are frequently arranged above the cutting head in order to improve the delivery of the solid particles. Here, upon interrupting the flow of the cutting jet there can arise an undesired further feeding of the solid particles into the mixing chamber because of the weight of such solid particles. Furthermore, there is required a controlled filling of the intermediate receptacle, as a function of particle consumption, from a remotely situated supply container or hopper. When the solid particles are pneumatically transported, there is required an interrupted re-filling operation with intermediate pumping empty of the transport or conveying lines.

In European Patent Application No. 0,152,223, published Aug. 21, 1985, there is disclosed a method and apparatus for producing cutting jets laden with abrasive particles. Transport of the abrasive or solid particles through a distance of 100 meters or more is contemplated. A carrier medium, particularly air, is delivered to a venturi, where there are admixed abrasive particles furnished from a supply container, the mixture is transported and the abrasive particles are removed in a separator and delivered by a pipe having a small diameter to a venturi containing a high-pressure cutting jet. What is here disadvantageous is that at the start of the operation there is required a great deal of time during which the abrasive or solid particles are delivered from the supply container to the separator. Furthermore, shutting-off of the cutting jet only can be feasibly undertaken when the pipe- and infeed line are extensively freed of abrasive particles, because otherwise there exists the danger of obstructing or clogging this line.

SUMMARY OF THE INVENTION

Therefore, with the foregoing in mind, it is a primary object of the present invention to provide an improved method of, and apparatus for, conveying solid particles to abrasive cutting apparatuses in a manner not afflicted with the aforementioned shortcomings and drawbacks of the prior art.

Another and more specific object of the present invention aims at the provision of an improved method, which while avoiding or at least appreciably minimizing the previously discussed drawbacks of the prior art, enables delivering solid particles and comparable abrasive particles from a supply device to a remotely situated liquid cutting head and retaining the delivered particles in a preparatory or ready state for charging a free-flowing or fluent cutting jet therewith.

Still a further important object of the present invention is to devise an improved apparatus for conveying solid particles or the like to a particle-charging apparatus, particularly a remotely situated particle-charging apparatus, in order to ensure for the reliable charging of a free-flowing or fluent cutting jet with such solid particles.

A further noteworthy object of the present invention is the provision of an improved apparatus for the efficient conveying of solid particles to fluid jet cutting equipment, particularly equipment which is located at a considerable distance, the particle conveying apparatus being relatively economical in construction and design, extremely reliable in operation, and requires a minimum of maintenance and servicing.

Now in order to implement these and still further objects of the present invention, which will become more readily apparent as the description proceeds, the solid particle conveying method of the present development is manifested, among other things, by the features that solid particles are moved in a closed cycle or circuit between a supply device and a particle receiving device, in particular a charging device or intermediate storage device of a cutting apparatus and there is removed from the closed cycle or circuit a quantity of solid particles which serves for the charging or loading of the cutting jet.

Certain of the more notable advantages realized by the present invention reside in the fact that holding in readiness or preparing the solid particles for charging of the cutting jet in the cutting head can be directly accomplished at any time and this can be undertaken independent of the operation of the fluid jet cutting apparatus, in other words, of the start of the flow of the cutting jet and the flow duration of such cutting jet.

If solid particles in a certain concentration are transported in a carrier medium between a supply device and a charging or intermediate storage device, then by utilizing suitable means there can be removed at any desired point in time a required or desired quantity of solid particles from the stream of carrier medium laden with the solid particles.

It is advantageous if the concentration of solid particles in the infeed line or system to the cutting head is accomplished by a dosed addition of solid particles to the carrier medium which is free of solid particles, and, if desired, recycled solid particles are separated and held in readiness for a renewed introduction into the supply device. It is thus possible, upon shutting-off the cutting jet, to interrupt or suppress the dosing or infeed of the solid particles and to clean the lines or conduits by means of the carrier or transport medium. In this respect, it is important that there be regulated a pressure at the removal location which is lower than the ambient pressure prevailing at this location.

As alluded to above the invention is not only concerned with an improved solid particle-conveying method, but also is directed to an improved apparatus for conveying solid particles, wherein connection means between the supply device and the charging device for charging the free-flowing or fluent cutting jet or jets with solid particles comprises at,/least two tubular-shaped means, such as tubular-shaped conduits or lines, for instance, channels, hoses, and the like.

BRIEF DESCRIPTION OF THE DRAWINGS

The invention will be better understood and objects other than those set forth above will become apparent when consideration is given to the following detailed description thereof. Such description makes reference to the annexed drawings in which.

DETAILED DESCRIPTION OF THE PREFERRED EMBODIMENTS

Figure 1:
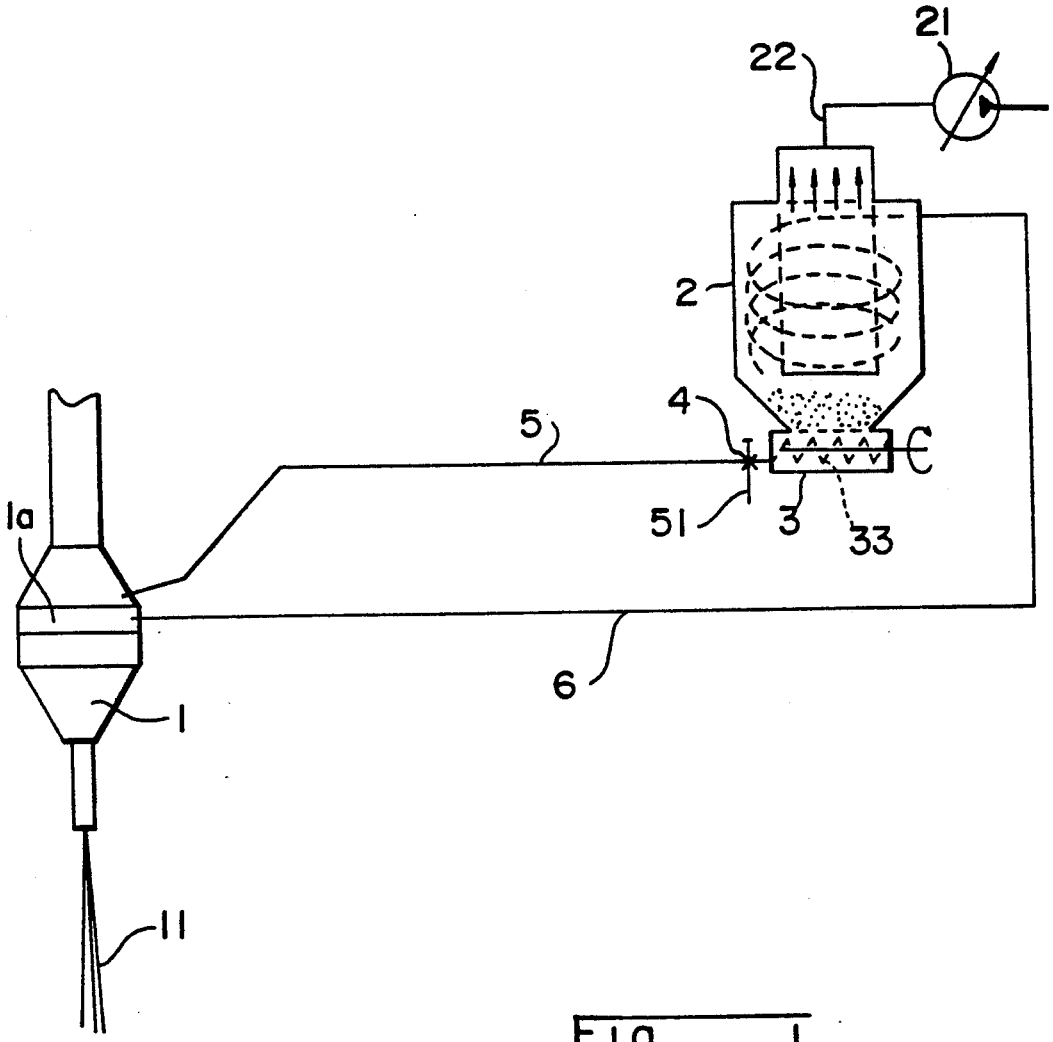
FIG. 1 schematically depicts the principle construction of a first embodiment of particle conveying apparatus of the present invention.

Describing now the drawings, it is to be understood that only enough of the construction of the solid particle-conveying apparatus has been depicted therein, in order to simplify the illustration, as needed for those skilled in the art to readily understand the underlying principles and concepts of the present invention. In the schematically depicted exemplary embodiments, there is shown an installation for supplying a fluid jet cutting device 1 with solid particles, such as pulverulent abrasive or grinding particles or grit or the like for charging a cutting jet 11 with such solid particles by means of a particle receiving device, such as a charging device la of such fluid jet cutting device 1. These solid particles are prepared in a supply and/or separator device 2 to be further considered hereinafter. By means of a dosing device 3, for example, a worm conveyor 33, the solid particles are delivered to a suitable mixing element 4, such as a jet nozzle. These solid particles are conveyed by a suitable carrier or transport medium, such as a gas, like air, or a dense liquid, like water, which enters by means of the infeed means or structure 51, through a connection means defined by an infeed or delivery line 5 to the charging device la of the cutting device or apparatus 1.

Figure 2:
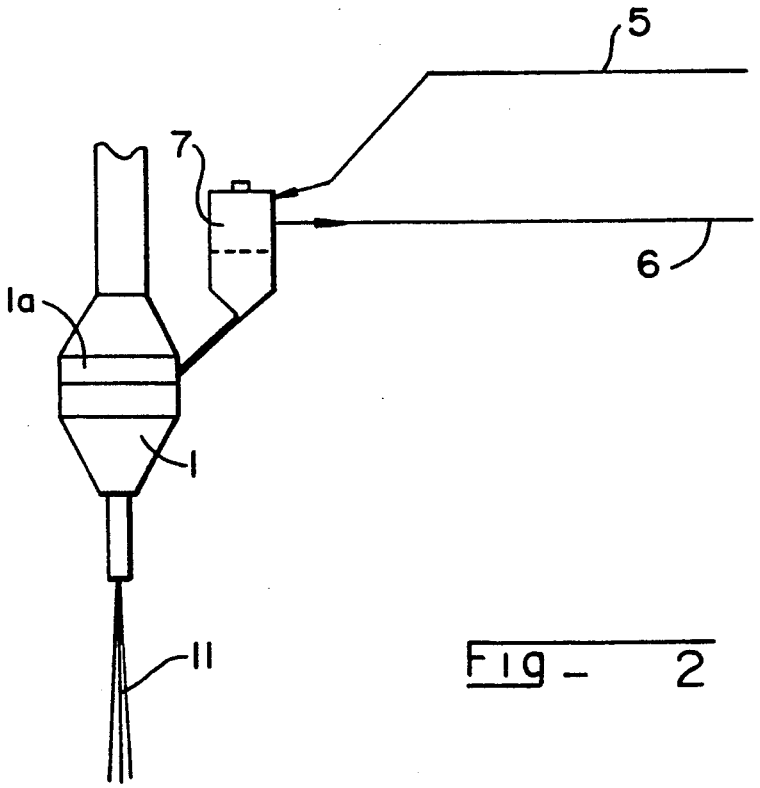
FIG. 2 is a fragmentary view of a slightly modified construction of the apparatus depicted in FIG. 1.

In the charging device la of the embodiment of FIG. 1 or at the region of a particle receiving device such as an intermediate storage device 7, as shown in the modified embodiment of FIG. 2 which otherwise generally corresponds to the embodiment of FIG. 1, there is removed at a hollow space or particle circulating passage, by the action of the cutting jet or by other suitable means, the momentarily required quantity of solid particles from the carrier medium. In the aforementioned commonly assigned, copending U.S. application Ser. No. 07/660,936, filed Feb. 26, 1991, there is disclosed in detail a suitable arrangement for the removal of solid particles suspended in a fluid carrier medium from a hollow space or particle circulating passage of a fluid jet cutting apparatus and the infeed thereof to the fluid cutting jet, and to which reference may be readily had and the disclosure of which is incorporated in its entirety herein by reference.

Figure 3:
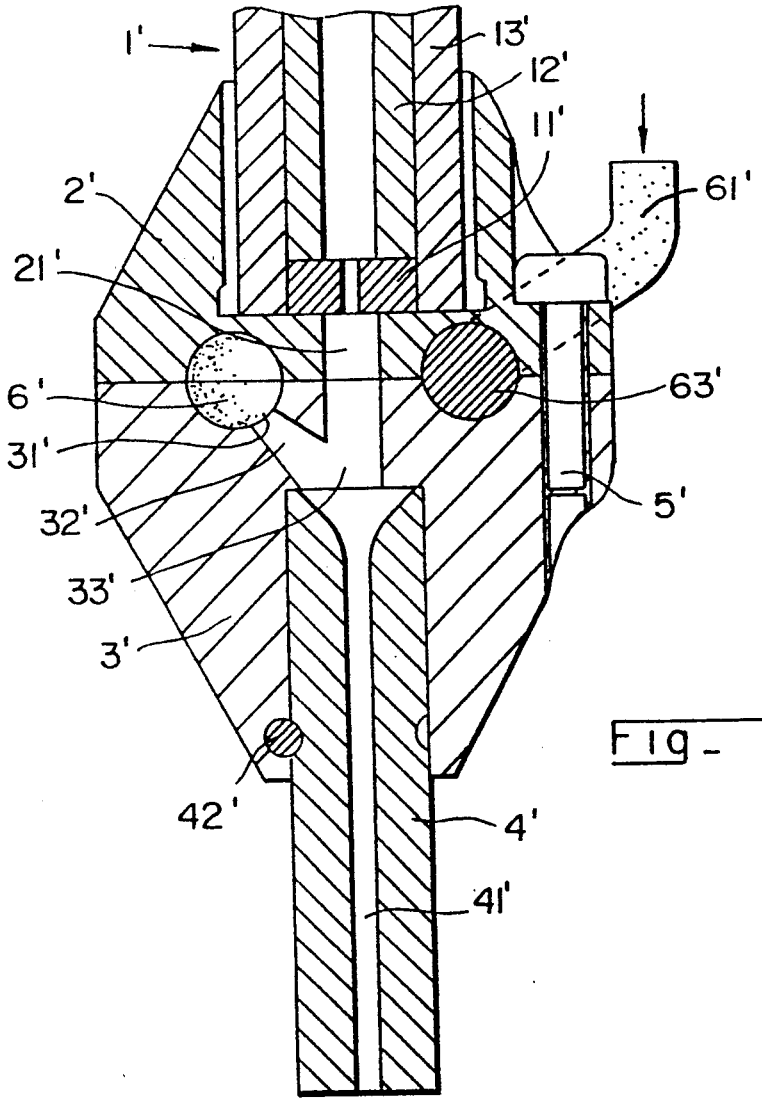
FIG. 3 is a longitudinal sectional view, taken substantially along the section line 3—3 of FIG. 4, through a cutting apparatus or cutting head constructed in accordance with the invention.
Figure 4:
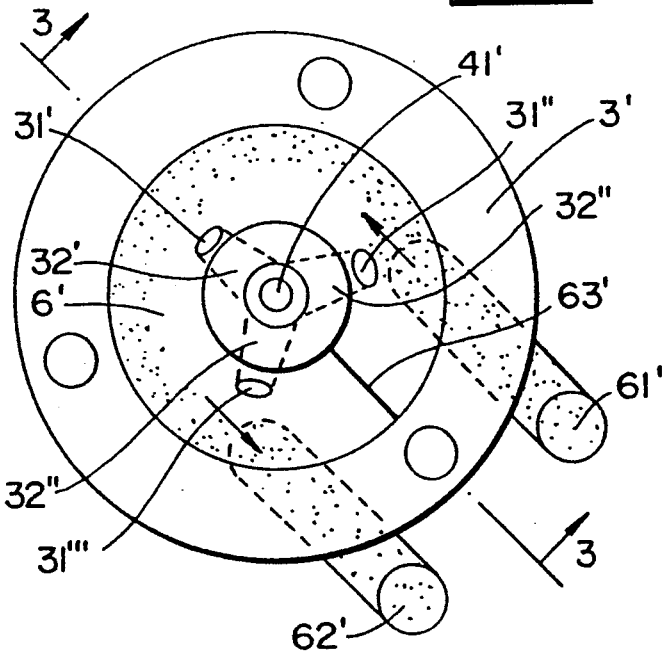
FIG. 4 is a top plan view of the cutting apparatus depicted in FIG. 3 but with the upper portion of the housing thereof removed.

In particular, in FIG. 3, there is depicted a sectional view of the jet cutting device or cutting head 1 and charging device 1*a* in an axial direction, the section having been taken substantially along the section line 3—3 of FIG. 4. A nozzle device or nozzle 1' equipped with high-pressure resistant walls 12' and 13' and a nozzle body 11' for forming a fluid cutting jet, such as a water jet, is adjustably and detachably connected with an upper housing portion 2' of a housing 2', 3'. This upper housing portion 2' possesses a bore or duct 21' through which there is flow directed toward the cutting jet. A focusing or constricting nozzle 4' provided with a throughflow channel or duct 41' for the cutting jet is retained by means of any suitable fixing or securing elements 42' within a lower housing portion 3'.

This lower housing portion 3' is connected by any suitable attachment or connecting elements 5', such as threaded bolts, with the upper housing portion 2'. Beneath the nozzle device 1' a hollow space or chamber 6', constructed as a substantially ring-shaped or annular hollow space, is formed by not particularly referenced coacting recesses provided in the housing portion 2' and 3', the hollowing space 6' being at least a part of the charging device 1*a*. An infeed means or line 61' for a fluid carrier medium, such as a liquid or gas, for instance water or air, entraining the solid particles or abrasive grit or the like is arranged neighboring the ring-shaped hollow space 6' as is also an outfeed means or line 62' for such solid particle-laden carrier medium. When using a liquid as the carrier medium for the solid particles there can be advantageously used a dense liquid with a buoyancy which essentially corresponds to the weight of the solid particles so as to keep them in a state of flotation or suspension. An essentially fluid-tight, such as gas or liquid-tight, closure means or element 63', like a partition wall interposed between the infeed line 61' and the outfeed line 62', closes or interrupts the ring-shaped hollow space 6' between these lines or channels 61' and 62', preferably at the region constituting the shortest distance between the entry locations of the lines or channels 61' and 62', preferably at the region constituting the shortest distance between the entry locations of the lines of channels 61' and 62' into the ring-shaped hollow space 6'. Instead of this arrangement, the ring-shaped hollow space 6' may be provided at the same region between the infeed line or channel 61' and the outfeed line or channel 62' with an opening or orifice of small cross-sectional area.

The ring-shaped hollow space 6' is connected for flow communication with a mixing chamber 33' formed at the upper region of the focusing or constricting nozzle 4' by at least one infeed means, typically an infeed channel or duct 32' which possesses at least one mouth surface or orifice 31'. In the embodiment depicted in FIGS. 3 and 4, there are provided, by way of example, three infeed channels 32', 32'', and 32''' which may be arranged at the same or different angular spacing from one another and in a star or ray-like configuration. The three infeed channels 32', 32'', and 32''' then have three mouth surfaces or orifices 31', 31'', and 31''' flow communicating with the ring-shaped hollow space 6'. Each such mouth surface or orifices 31', 31'', and 31''' preferably may be smaller in size than the cross-sectional area of the hollow space 6' and/or the outfeed means or channel 62'.

FIG. 4 depicts in top plan view the ring-shaped or annular hollow space 6' with the infeed line or channel 61', the outfeed line or channel 62' and the intermediately disposed closure means 63'. As explained previously, the ring-shaped hollow space 6' has flow communicating therewith three mouth surfaces or orifices 31', 31'', and 31''' of the three infeed channels or ducts 32', 32'', and 32''', respectively, arranged in a star-like configuration.

In accordance with the invention, if the solid particles suspended in a carrier medium are introduced through the infeed means or line 61', then moved further in the ring-shaped hollow space 6' and outfeed by the outfeed means or line 62' and if there is adjusted in the ring-shaped hollow space 6' a lower or reduced pressure in relation to the ambient or surrounding pressure at the cutting head, in other words, the delivery is accomplished with under-pressure or negative pressure, then ambient gas, for instance, air is sucked-in through the channel or duct 41' of the focusing or constricting nozzle 4' and through the mouth surfaces or orifices 31', 31'', and 31''' and there is prevented entry of the solid particles into the infeed channels of ducts 32', 32'', and 32'''. Upon turning-on the high-pressure cutting jet there is formed in the mixing chamber 33', by virtue of the passage of the high-pressure cutting jet through the channel or duct 41' of the focusing nozzle 4', a lower pressure than the pressure prevailing in the hollow space 6'. Consequently, solid particles are now introduced by means of the infeed channels 32', 32'', and 32''' into the mixing chamber 33' and the cutting jet is effectively charged with these infeed solid particles. An interruption in the flow of the cutting jet also brings about an interruption in the infed of the solid particles. Furthermore, it is possible to align the particle-laden cutting jet in three dimensions, that is, to cut omnidirectionally, because no use of the force of gravity is resorted to for holding in readiness the solid particles.

Continuing, the carrier medium, which still possibly contains some retained solid particles and moving in connection means defined by an outfeed or return line or conduit 6 or the like, is delivered to the supply and/or separator device 2. This supply and/or separator device 2 can be constructed as a cyclone, and it is advantageous if a vacuum removal pump 21 sucks-off carrier medium essentially free of solid particles out of the cyclone by means of the withdrawal line or conduit 22 operatively connected with vacuum removal pump 21. In this way, it is possible to employ pumps of simpler design and/or to reduce pump wear.

Additionally, it is advantageous if the pressure of the carrier medium at the point of removal of the solid particles, in particular at the region of the hollow space of the charging device 1*a* or the particle circulating passage of the intermediate storage device 7, is regulatable and is maintained at least equal to but preferably at a lower pressure than the surrounding or ambient pressure in order to regulate the flow of the solid particles in the closed circuit. Particularly when using long and/or thin lines or conduits, carrier medium can be forced by a not here shown but conventional pump into the infeed means 51, arranged proximate the supply and/or separator device 21, and with the aid of the further pump 21 and the outfeed or return line or conduit 6 can be removed by suction from, in particular, the supply and/or separator device 2. With such type apparatus it is also possible, especially for the introduction of solid particles to the intermediate storage device 7, to periodically regulate the pressure at the particle circulating passage to be greater than the ambient pressure, and thus, to facilitate the removal of solid particles. Furthermore, with the aid of a suitable sensor, such as a conventional level sensor, there can be determined the available amount of solid particles in the intermediate storage device 7 and as a function of the removal of solid particles therefrom by the charging apparatus 1 there can be augmented or increased the supply of the available amount of solid particles.

Upon placement into operation of the fluid jet cutting apparatus, the closed circuit or cycle for the carrier medium can be activated and the solid particles infed, that is, delivered to the mixing element 4 in order to convey the solid particles. If the cutting jet is turned-off, then the addition of the solid particles can be terminated, so that by the action of the flowing carrier medium the lines or conduits 5 and 6 can be completely emptied and cleaned. Consequently, in a simple manner there is enhanced the functional reliability of the apparatus for the conveying of the solid particles and there is beneficially increased the degree of utilization of the solid particles.

While there are shown and described present preferred embodiments of the invention, it is distinctly to be understood the invention is not limited thereto, but may be otherwise variously embodied and practiced within the scope of the following claims.

What is claimed is:

1. A method of conveying solid particles from a supply device to a charging device of a fluid jet cutting apparatus for charging at least one free-flowing cutting jet with such solid particles, comprising the steps of:

removing the solid particles from the supply device;

introducing the solid particles into a carrier medium for transport thereof;

moving the solid particles through a closed circuit, said solid particles being transported in the carrier medium between the supply device and a particle receiving device of the fluid jet cutting apparatus; and removing from the closed circuit at least a portion of the solid particles which serves for the charging of the cutting jet.

2. The method as defined in claim 1, further including the step of:

using as the particle receiving device the charging device.

3. The method as defined in claim 2, further including the step of:

adjusting a pressure in the carrier medium at a point of removal of the solid particles from the closed circuit which is less than ambient pressure in order to regulate a flow of the solid particles moving in the closed circuit.

4. The method as defined in claim 3, wherein:

there is selected as the point of removal of the solid particles from the closed circuit a region of the charging device where the cutting jet is charged with the solid particles.

5. The method as defined in claim 1, further including the step of:

using as the particle receiving device an intermediate storage device.

6. The method as defined in claim 5, further including the steps of:

determining at the intermediate storage device an available amount of solid particles; and augmenting the determined available amount of solid particles as a function of removal of the solid particles by the charging device.

7. The method as defined in claim 1, further including the step of:

adjusting a pressure in the carrier medium at a point of removal of the solid particles from the closed circuit which is substantially equal to ambient pressure in order to regulate a flow of the solid particles moving in the closed circuit.

8. The method as defined in claim 1, further including the step of:

regulating a concentration of the solid particles in the carrier medium in an infeed line extending between the supply device and the particle receiving device by use of a dosing device for dosing the solid particles.

9. The method as defined in claim 1, further including the steps of:

separating solid particles re-cycled back to the supply device; and holding in readiness the separated solid particles.

10. The method as defined in claim 9, wherein:

the separation of the solid particles re-cycled back to the supply device is undertaken in a cyclone.

11. The method as defined in claim 1, further including the step of:

using as the carrier medium for the moving of the solid particles a gaseous medium.

12. The method as defined in claim 1, further including the step of:

using as the carrier medium for the moving of the solid particles a liquid medium.

13. The method as defined in claim 1, further including the step of:

moving the solid particles in a hollow space of the charging device of the fluid jet cutting apparatus.

14. The method as defined in claim 1, further including the step of:

arranging the charging device at a remote distance from the supply device.

15. An apparatus for conveying solid particles to a charging device for charging free-flowing cutting jets with the solid particles, said apparatus comprising:

a supply device in which the solid particles are stored and introduced into a carrier medium;

connection means for an infeed of the solid particles to the charging device;

means for moving the solid particles in a circuit, said circuit extending through an area proximate at least one free-flowing jet, for holding in readiness the solid particles for diverting at least a portion of the solid particles from said circuit in charging said at least one free-flowing cutting jet with the solid particles; and said connection means comprising at least two tubular-shaped lines, said at least two tubular-shaped lines comprising at least a portion of said circuit.

16. The apparatus as defined in claim 15, wherein:

said connection means comprise at least one infeed line and one outfeed line for the solid particles transported in the carrier medium.

17. The apparatus as defined in claim 16, further including:

means for separating solid particles from the carrier medium connected with the outfeed line.

18. The apparatus as defined in claim 17, wherein:

said means for separating the solid particles from the carrier medium comprises a cyclone.

19. The apparatus as defined in claim 15, further including:

at least one pump means for moving the solid particles located in the carrier medium; and said at least one pump means being arranged at a region of said supply device.

20. The apparatus as defined in claim 19, wherein:

said at least one pump means is disposed at a location where the carrier medium is essentially devoid of the solid particles.

21. The apparatus as defined in claim 15, further including:

means for infeeding the carrier medium;

dosing means for feeding a dosed quantity of the solid particles for incorporation into the carrier medium infed by said infeeding means;

at least one mixing element for introducing a quantity of the solid particles fed by the dosing means into the carrier medium; and said at least one mixing element being arranged proximate to said supply device.

22. An apparatus for conveying solid particles to a fluid jet for emitting at least a portion of the solid particles in a first direction, said apparatus comprising:

a supply device for storing the solid particles;

a charging device for charging the at least a portion of the solid particles to the fluid jet;

a delivery line for directing the solid particles in a direction toward the charging device;

a feeding device for feeding the solid particles from the supply device and into the delivery line;

a return line for directing the solid particles in a direction from the charging device; and means for introducing a carrier medium into the delivery line for carrying the solid particles through the delivery line to the charging device;

the charging device comprising means for directing the solid particles through the charging device along a path, including a second direction of flow, the second direction of flow being different from the first direction of flow of the fluid jet, wherein:

a closed circuit for the solid particles is provided, the closed circuit including the supply device, the delivery line, the charging device, and the return line, and wherein the apparatus further comprises:

means for continuously propelling the solid particles through the closed circuit and for containing the solid particles within the closed circuit until activation of the fluid jet for diverting at least a portion of the solid particles from the closed circuit.

* * * * *